United States Patent [19]

Paquet

[11] Patent Number: 4,685,800

[45] Date of Patent: Aug. 11, 1987

[54] ALIGNMENT SYSTEM

[75] Inventor: Laurent J. Paquet, Ancienne Lorette, Canada

[73] Assignee: Her Majesty the Queen in right of Canada, Ottawa, Canada

[21] Appl. No.: 631,178

[22] Filed: Jul. 16, 1984

[30] Foreign Application Priority Data

Dec. 30, 1983 [CA] Canada ..... 444532

[51] Int. Cl.[4] ..... G01B 11/26

[52] U.S. Cl. ..... 356/152; 340/982; 342/398

[58] Field of Search ..... 340/982; 343/398; 356/152; 342/398

[56] References Cited

U.S. PATENT DOCUMENTS

| | | | |
|---|---|---|---|
| 3,400,398 | 9/1968 | Lapeyre et al. | 343/398 |
| 3,714,657 | 1/1973 | Lapeyre | 343/398 |
| 3,881,824 | 5/1975 | Higgins | 356/152 |

FOREIGN PATENT DOCUMENTS

| | | |
|---|---|---|
| 1181162 | 2/1970 | United Kingdom . |
| 1420647 | 1/1976 | United Kingdom . |

*Primary Examiner*—Stephen C. Buczinski

*Attorney, Agent, or Firm*—Stevens, Davis, Miller & Mosher

[57] ABSTRACT

Disclosed is a system for aligning elements in azimuth, in particular guns of artillery batteries. A prior system of this type uses an omnidirectional xenon beacon which produces pulses to indicate rotation of a reference unit, a double pulse indicating a reference director. A receiver counts pulses until it detects a directional laser beam from the reference unit, the number of pulses given a reading of what is known as a reciprocal bearing. The xenon and laser pulses are optically separated in the receiver. The prior system is not as reliable as desired, mainly because of scintillation effects. The present invention overcomes this problem by identifying different pulses by the pattern of their arrival times. A detector unit generates and stores numbers each having a magnitude proportional to their time of arrival. The numbers are processed by a microprocessor to determine the angle through which the laser beam travels between a reference direction and the direction of the detector unit. The system can compensate for slow changes in speed of rotation of the beacon and overcomes the effects of scintillation of signals over heated terrain. The receiver is lighter than one using optical pulse separation.

5 Claims, 9 Drawing Figures

ALIGNMENT SYSTEM

This invention relates to devices for aligning elements in azimuth and has a particular application to devices for aligning guns of artillery batteries.

Before artillery guns can be fired they have to be aligned, which requires two reference lines to be defined at each gun. The first or vertical reference line, for gun elevation, is readily determined using gravity. The second or azimuth reference line (usually the North direction) is more difficult to define and maintain.

According to a known method, when an artillery battery is in the process of relocating, a reconnaissance party establishes a new battery site and they mark the gun positions to be taken up by the guns of the battery and also set up the battery aiming circle or director. This instrument is a military version of a transit. The azimuth scale of the aiming circle is aligned using a magnetic compass or a gyro-orientor. The guns are then moved into position and are aligned parallel to each other, usually in the center of arc direction, that is to say a direction which allows the normal traverse of the guns to cover the sector of main interest. Alignment of the guns is carried out using the reciprocal bearing method. Taking each gun in succession, the bearing of that gun from the aiming circle is measured and passed to the gun by voice, radio or runner. The gun sight when pointed at the aiming circle is then pointing in the reciprocal bearing. By using the scales on the gun sight, one of which indicates the angle between the gun sight optical axis and the direction in which the gun tube is pointing, the gun tube can be offset the required calculated amount so that it is aligned on the chosen center of arc. To prevent errors, each reading is independently checked and all the data is passed at least twice, that is from aiming circle to gun and from gun to aiming circle. The whole process has to be repeated at least twice since the position of the gun sight, which is offset from the center of rotation of the gun, will change if the gun is moved to point in the center of arc direction. This is then repeated for each gun on the battery. When this process is completed the battery is aligned and prepared to receive requests for fire.

Usually reference poles are set out by each gun crew so that after the gun is fired any displacement from the original position caused by the recoil of the gun can be adjusted.

A major drawback of the above-described method is the great length of time required to align a troop of guns. For example in bad weather conditions it can take from 10 to 30 minutes to perform the alignment operation and in mobile modern warfare where weapons must be moved frequently this delay becomes an important factor. A further drawback of the method is that since it involves computation of angles, manual settings and reading of aiming circles and sights and verbal passage of information, there is a marked probability of human error, especially in action conditions. Furthermore, the number of guns which can be handled by the prior-art aiming circle is restricted because of the time necessary to handle each gun.

An improved azimuth alignment system is disclosed in British patent No. 1,420,647 of John Higgins, patented Mar. 13, 1973. The system disclosed in that patent includes a reference unit which can be aligned in a known orientation, e.g., North or South. The reference unit includes a laser, which provides a highly collimated light beam, and an omnidirectional xenon beacon. The laser light beam is rotated and each time it passes a datum position the beacon produces a double pulse. The beacon also produces single pulses, e.g. 640 pulses per revolution of the beam. A receiver on each gun counts pulses from the beacon to drive a display which is initialized (set to zero) upon reception of the double pulse from the beacon. When the receiver detects the laser beam, it stops the count on the display which provides an indication of an angle of gun position relative to the datum so that the gun can be aligned. Once the gun is properly aligned with the datum direction, it can be off-set as required to aim in the direction of a target.

The system described in the abovementioned patent uses a dichroic filter to separate the laser radiation and xenon radiation which are then detected by separate photodiodes. This system has, however, proved to be not as reliable as desired, mainly due to intensity modulation of the IR beacon signals by air turbulence over terrain heated by the sun (scintillation). The present invention overcomes this problem by abandoning the somewhat ineffective optical separation of laser and xenon signals and identifying different pulses by the pattern of their arrival times. Noise pulses can be identified and "lost" pulses can be inserted once the signal pattern is established. The system according to the invention can compensate for slow changes in speed of rotation of the beacon and confidently overcomes the effects of scintillation of signals received over heated terrain. Eliminating the separation of laser and xenon pulses by optical means simplifies and reduces the weight of the IR receiver, making it more suitable for mounting on a gunsight.

According to a broad aspect of the invention there is provided an azimuth alignment system comprising a reference unit adapted to be aligned in a known orientation and having at least one source of highly directional light pulses adapted to be rotated about a vertical axis, a source of omnidirectional light pulses, and means to trigger said source of omnidirectional light pulses each time said source of highly directional light pulses rotates by a predetermined angular increment and also when it passes a predetermined reference direction, said system including a detector unit mounted on a device to be aligned, which detector unit includes an optical receiver for receiving light pulses, means for generating and storing numbers each having a magnitude proportional to time of arrival of a light pulse at said optical receiver, and means for processing said numbers to determine the angle through which said source of highly directional light pulses travels between said reference direction and the direction of said detector unit.

The invention will now be further described in conjunction with the accompanying drawings, in which.

Figure 1:
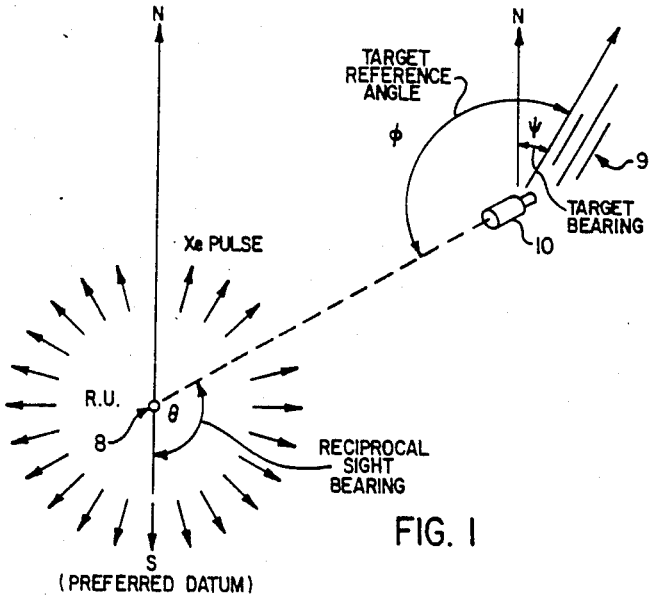
FIG. 1 is a diagrammatic representation of a gun position relative to a reference unit.
Figure 3:
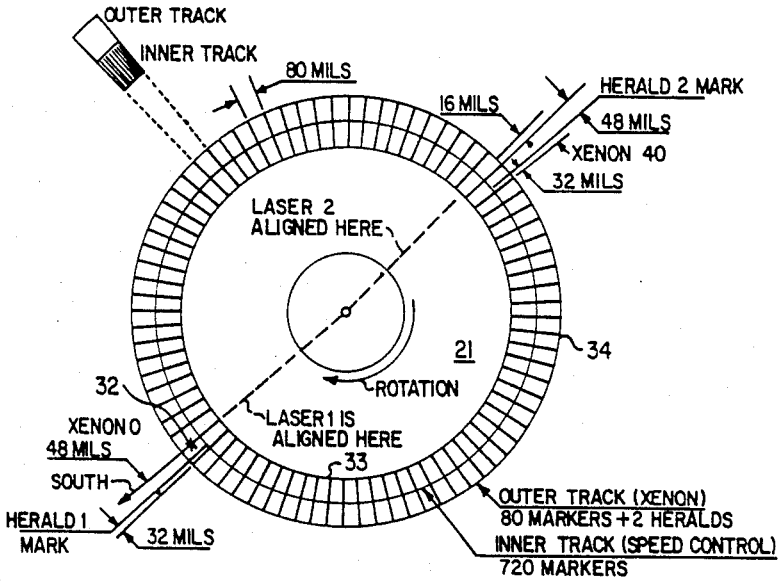
Figure 4:
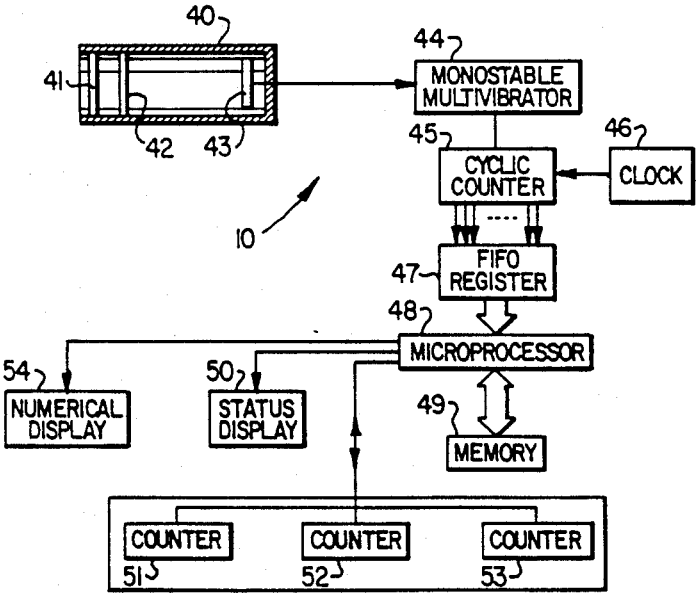
Figure 5A:
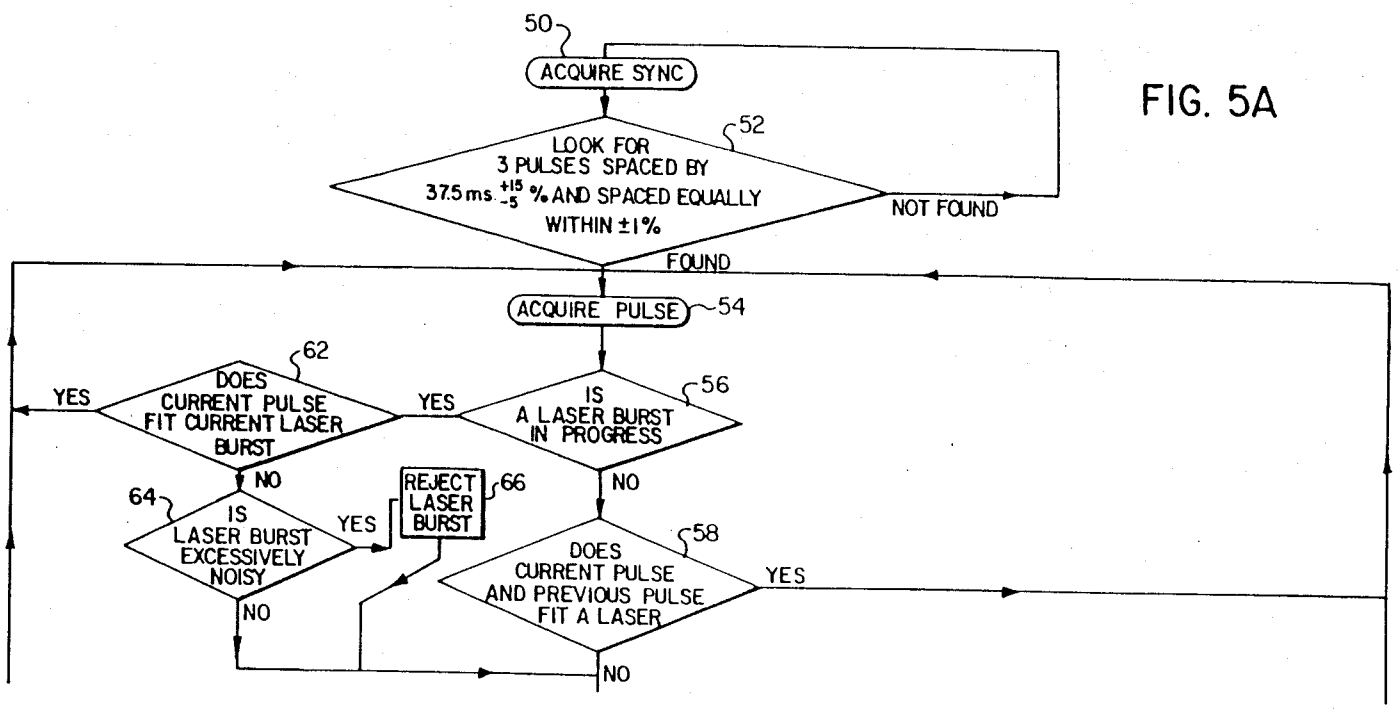
Figure 5B:
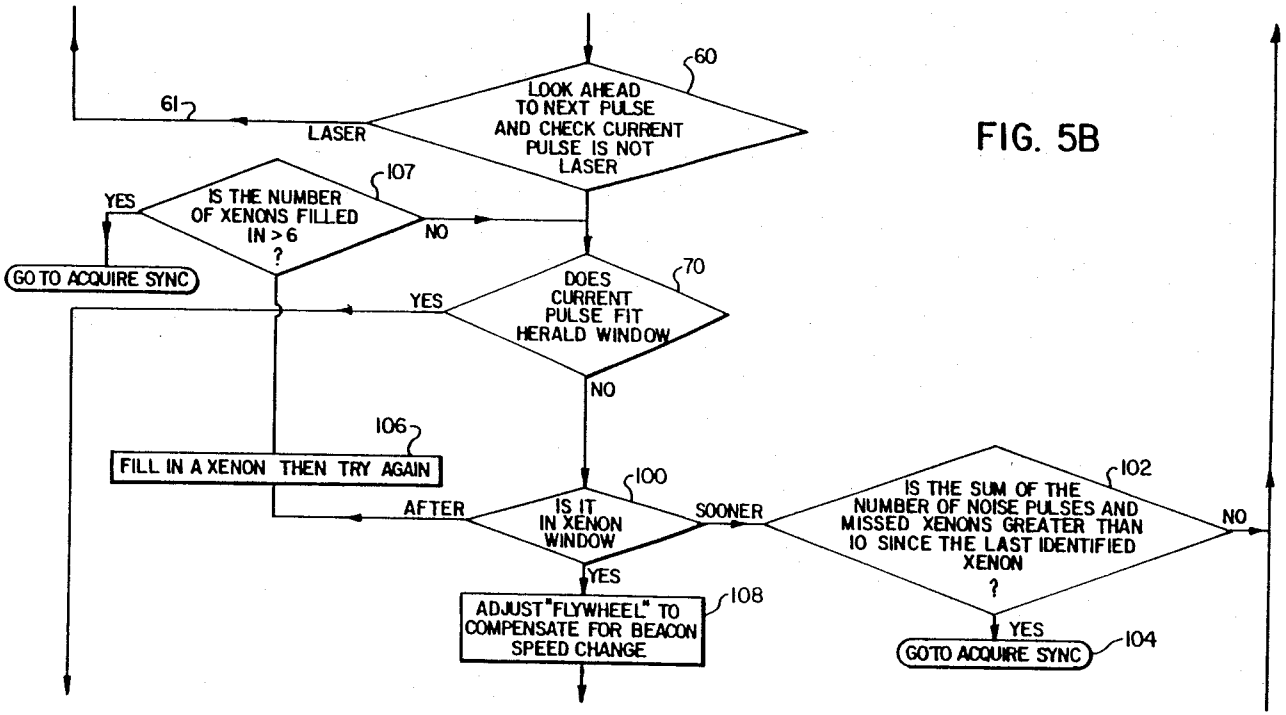
Figure 5C:
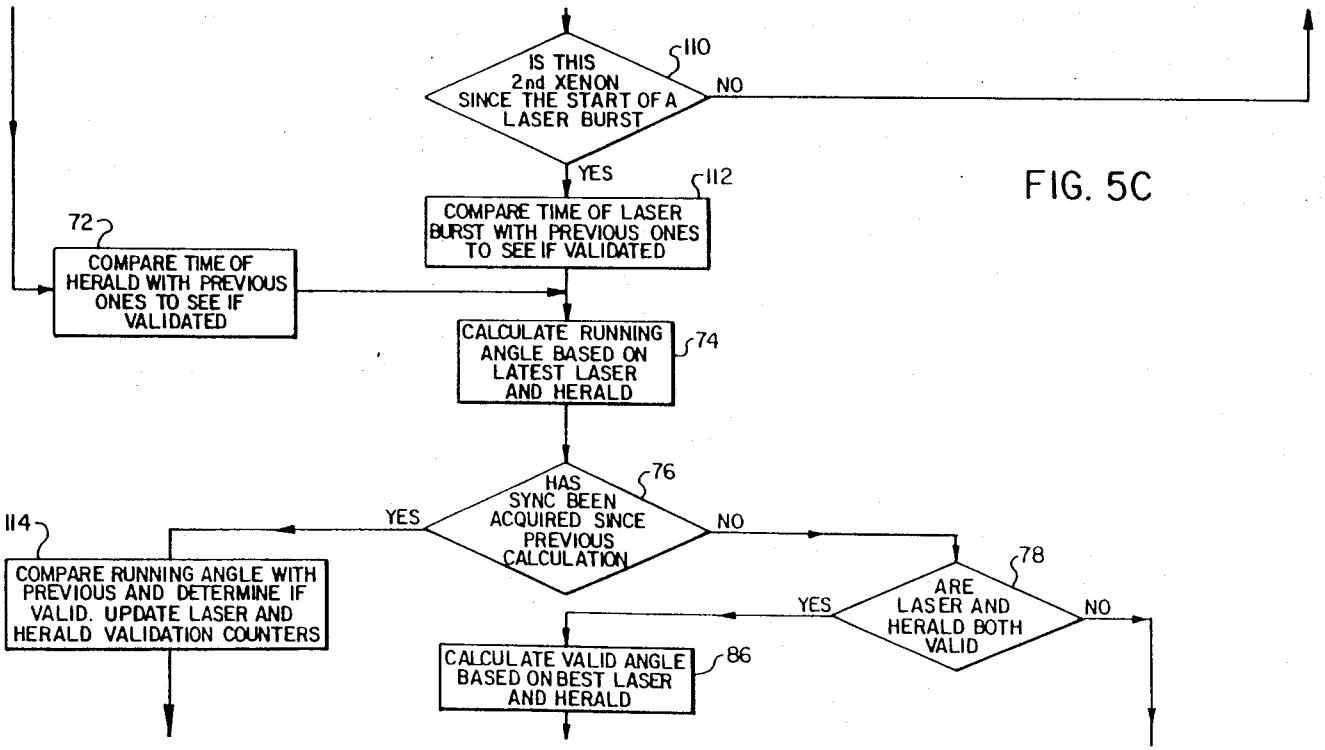
Figures 5D, 5E:
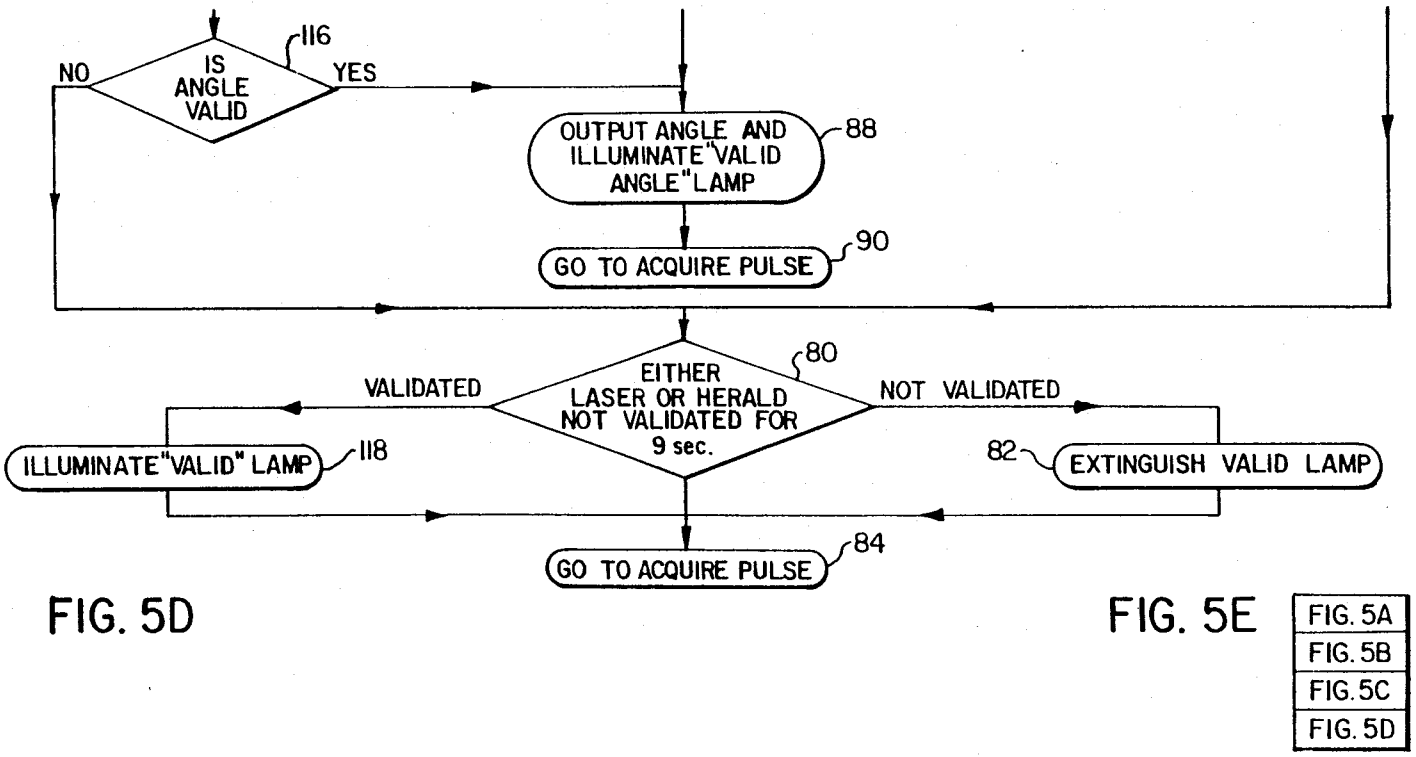

FIG. 3, on the first sheet of drawings, is a detailed view of an encoder disc used in the reference unit;

FIG. 4, on the second sheet of drawings, is a block diagram of a detector according to the present invention, and FIG. 5A to 5D, which fit together as shown in FIG. 5E, comprise a flow chart useful in explaining the functioning of the detector. FIG. 1 illustrates the basic geometry involved in gun alignment procedures and defines the angles used in the description. A reference unit (R.U.) 8 is located near the artillery command post position and a battery of guns, one of which is diagrammatically illustrated at 9, are positioned about the command post roughly in a semi-circle. Each gun has a receiver unit 10 mounted thereon to receive signals from the reference unit 8. The angular measure used in this specification will be that used by the military, 1 mil = 1/6,400 revolution.

The purpose of the alignment system is to indicate angle $\phi$ to the gunner, i.e., the angle which he should lay off from the number 1 aiming point (the R.U. 8) to set the gun 9 in azimuth onto a target. When the R.U. 8 is properly aligned to South, and the gunsight is set onto the R.U. 8 so that the receiver unit 10 may receive its signals, the alignment system can determine the angle $\theta$, that is the reciprocal sight bearing. The angle $\psi$ is transmitted to the alignment system by any suitable means, e.g. radio, and the alignment system can then calculate the angle $\phi$ by summing angles $\theta$ and $\psi$ and display the result.

The Reference Unit (RU) (FIG. 2) consists of two sub-units, a base mounting 12 and a main casing 13 which may be rotated with respect to the base mounting 12. The base mounting 12 is designed to be mounted directly on an instrument, such as a theodolite or aiming circle, which in turn is mounted on a tripod head. The tripod head allows for levelling of the instrument and the reference unit. The instrument and tripod head are not shown. The main casing 13 is locked by the lock pin 14 relative to the base mounting 12 after its South reference line has been aligned in azimuth with respect to the telescope of a standard optical instrument.

In use, the instrument (and, hence, the reference unit) are aligned to the preferred grid datum (South) by means of a magnetic compass or gyro-orientor or other suitable means. The main casing 13 contains power supplies 16, a motor 15 and a drive system for rotating the platform 17. The motor 15 may be an a.c. synchronous motor which derives its power from a supply controlled by a stable oscillator in conventional fashion. Alternatively, a d.c. motor with a tachometer type of speed control could be used. The drive system includes a gearbox (speed reducer) and a final belt drive (not shown) to a driven pulley 20. The driven pulley 20 and the platform 17 rotate together on two bearings 23 which are carried on a fixed shaft 22. The shaft 22 is secured rigidly in the main casing 13 so that it may support the assembly in the upper part of the reference unit. The shaft 22 is hollow so that the electrical wiring may pass through to the upper assembly. This arrangement avoids the problem of support posts and wiring passing up the outside and obstructing the laser radiation.

The upper part of the main casing 13 includes three light sources. (The term light source is used loosely here since in this embodiment all of the radiation emitted by the reference unit 8 is confined to that region of the spectrum above 0.7 microns, i.e., the near infra-red). Two sources comprise pulsed GaAs laser units 24 and 25 which emit narrow light beams which rotate about the vertical axis of the reference unit. To achieve this, the lasers are mounted on the rotating platform 17 which is driven at a uniform rate of one revolution in three seconds by the motor 15. The radiation from the lasers is shaped by anamorphic optical systems into beams with a divergence of 0.3 mil in the horizontal plane and 220 mils in the vertical plane. Mounted above, on the same axis, but not rotating, is a xenon flash tube 30 with a suitable Fresnel lens 31 to give omnidirectional radiation in the horizontal plane with a beam spread of 220 mils in the vertical plane. (A suitable flash lamp could be an EG and G Type FX-6A.) This will be referred to as the beacon. The beacon need not be totally omnidirectional provided that it have a spread sufficient to encompass all receivers associated with it. If necessary for security reasons, an optical filter 26 can be used to enclose the beacon so that only infra-red radiation is emitted. In the practical application of this device, it is advantageous to totally enclose the apparatus in a sealed assembly comprising the main casing 13, the transparent cylinder 33 and the upper cover 29.

A slip ring and brush assembly 27, 28 is provided for feeding electrical power to the rotating laser platform assembly, 17, 24, 25. An encoder disc 21, to be further described in conjunction with FIG. 3, is mounted underneath the platform 17 and rotates with it. Markings on the disc 21 are detected by an optical detector 32 which produces electrical pulses denoting each 80 mils of rotation on the turntable, i.e., 80 pulses per revolution. These pulses trigger the xenon beacon 30.

Figure 2:
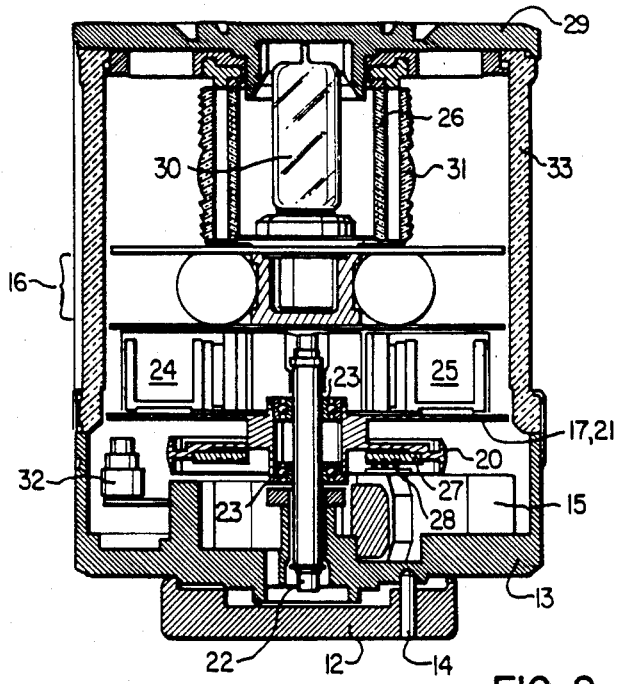
FIG. 2 is an elevational view, partly in cross-section, of a reference unit in accordance with the present invention.

Referring to FIG. 3, the encoder disc 21 has an inner track 33 used for controlling rotation speed of the laser platform assembly 17, 24, 25 (FIG. 2). Any suitable speed control can be used and, as the invention is not directly concerned therewith, it will not be described in detail.

The marks on the outer track 34 trigger the omnidirectional source 30 when detected by the fixed optical sensor 32, positioned as indicated by an asterisk in FIG. 3. Thus, the omnidirectional source (beacon) 30 generates a continuous train of light pulses indicative of the rate of rotation of the laser platform assembly 17, 24, 25.

The regular xenon mark "0" on outer track 34 causes the beacon 30 to flash as the laser 1 passes through South. (A gun looking at the beacon and receiving the laser pulse would be facing North.) To enable mark "0" to be identified, the track 34 is provided with an extra mark, "Herald 1", which occurs 48 mils later. Similarly, the regular xenon mark 40 on the outer track 34 causes the beacon 30 to flash as laser 1 passes through North, mark 40 being identified by Herald 2 which occurs 32 mils after it.

Laser 2 is aligned almost, but not quite, 3200 mils (180°) from Laser 1. In FIG. 3, laser 2 is 3104 mils from laser 1; the small offset of 96 mils ensures that there is no position around the reference unit at which both Heralds could be obscured by high energy laser signals, which generate a train of pulses in the receiver.

The light pulses from the beacon and the lasers are received by a detector 10, FIG. 1, mounted on top of and optically aligned with the gunsight. In clear atmospheric conditions the detector receives xenon pulses at the rate of 80 per beacon rotation period of 3 seconds, plus the two Herald pulses discussed above. In addition, it will receive a burst of pulses from each laser 24 and 25 as it sweeps past. The timing of the laser bursts in relation to the xenon and Herald pulses is dependent upon the location of the gun around the reference unit 8. Under conditions of high background illumination and weak light pulse signals some spurious pulses (noise) may be generated in the detector but will not be related to the cyclic pattern of pulses received from the reference unit 8, and hence can be discriminated from the light signal pulses.

When the atmosphere is turbulent, the signals received will be modulated in amplitude and some of them may be reduced below the threshold of detection and be lost. The probability however is that a particular signal lost in one revolution will be received in subsequent ones.

All signals received at the detector are amplified and converted to standard pulses if they exceed the threshold level, e.g. 5 volts, 7 microseconds wide.

Referring to FIG. 4, the detector, generally referenced 10, is shown in block diagram form as comprising an optical receiver 40 which includes a filter 41 for passing infrared radiation (while blocking visible light radiation) to a Fresnel lens 42 which focusses the radiation on a photodetector 43. The detector sensitive surface may be advantageously formed as a vertical strip, so that radiation will be received over a wider angle in the vertical direction. Radiation may then be received from the similarly vertically dispersed radiation from the beacon when the two devices are at different heights on the terrain. The same effect can be achieved by using a cylindrical lens on the detector but a considerable loss in signal strength occurs because all the radiation does not fall on the detector. Infrared pulses from the beacon 30 or the lasers 24, 25 result in the photodetector 43 triggering the monostable multivibrator 44 which produces standard output pulses which are passed to cyclic counter 45.

The interpretation of the pulse train output from the reference unit 8 is done in the detector 10 under the control of microprocessor 48. Pulses are recognized by the pattern in their time of arrival and angles which are calculated are further verified by the fact that they repeat. Pulses received by the detector unit are processed by referencing their arrival time to a cyclic 18 bit series of binary numbers. Thus, in FIG. 4, the clock 46 continuously increments the cyclic counter 45 and every time the monostable multivibrator 44 produces an output pulse the current count in counter 45 is fed into a FIFO (First In, First Out) register 47. Each pulse therefore "takes a number" corresponding to its arrival time and the number is stored in FIFO register 47. The microprocessor 48 will take a number from FIFO register 47 and put it through a series of tests to determine what kind of signal it represents. It does this by establishing synchronisation with the beacon rotation based on the uniformly spaced regular xenon signals. The Herald signals are identified by their individual timing relative to regular xenon signals. (As discussed above, Herald 1 occurs 48 mils after xenon 0 and Herald 2 occurs 32 mils after xenon 40.) Laser pulses can be recognized because they occur in groups, spaced according to the frequency of the laser they represent. Pulses not fitting the pattern are rejected as noise and hence do not enter into angle calculations.

The dumping of pulses as noise is time consuming because they have to be given every test first. Normally this is no problem because their number is small. Should, for any reason, a heavy burst of noise arrives and fills up the FIFO 47 (normal signal patterns cannot do this) the contents of FIFO 47 are "dumped" so that the system can be made ready to process useful information as soon as possible.

Once a number is identified as to signal type it is stored by the microprocessor in a memory 49 and subsequently used by the microprocessor 48 to calculate the reciprocal bearing angle $\theta$(see FIG. 1). The reception of two laser signals and two Herald signals enables the calculation of four values for the angle $\theta$ per 3 second rotation period of the reference unit 8. The value can be verified by checking if it is repeated according to validation rules, set forth below. Once verified, the angle $\theta$ can be displayed and/or used to calculate the angle $\theta$ by summing with the target bearing $\psi$(FIG. 1). A valid reference indicator light on status display 50 may be lit to show the angle is valid. If signals are interrupted for more than a prescribed period, the valid angle indicator light is extinguished, but the angle is displayed until a different angle is verified.

Reception of a group of xenon pulses causes a xenon indicator to light once synchronism is established according to predetermined criteria, discussed below. In poor transmission conditions some pulses may be missing but the microprocessor 48 inserts pulse numbers to complete the pattern so that the estimate of the rotation speed of the reference unit, essential to convert time to angle, may appear steady. The system can compensate for slow variations in speed of the reference unit and can tolerate and average out time variations (jitter) in xenon signal arrival.

Laser signals consist of a burst of pulses. A minimum group can be recognized as a laser burst and the microprocessor estimates the center of the burst as the time of the laser arrival. Pulses missed from a group could bias this estimate; therefore once the group is verified the centre of the laser burst is calculated from the mean of the first and last pulses.

Each time a group of pulses is identified as a laser burst a laser indicator lamp on status display 50 is lit for a predetermined time, e.g. 1.6 seconds, thus confirming laser reception. If both lasers are being received every revolution of the reference unit, the laser indicator circuit is reset every 1.5 seconds so that the indicator lamp is lit steadily.

The lasers are given different pulse repetition frequencies which produce short bursts of pulses at the receiver 40 which can be distinguished by their different pulse spacings. Reliability and speed of angle acquisition are improved by duplicating lasers and Heralds.

The ability of the microprocessor to interpolate between xenons and correct for beacon speed variations means that the xenon pulses can occur relatively infrequently without loss of accuracy. The reference unit 8 can rotate relatively slowly and the xenon pulses can be made quite powerful, giving improved reliability of reception. Power consumption is reduced, it being noted that the omnidirectional xenon uses a lot of power. The xenon tube also lasts longer at lower repetition rates.

The ability of the microprocessor to compensate for slow variations in beacon speed simplifies the design of the beacon drive.

The microprocessor 48 (FIG. 4) identifies pulses as laser, xenon, Herald or noise and measures their time of occurrence on a time scale tracked to the xenon pulse rate (i.e. laser platform rotation rate). By using two Heralds and two lasers, four angles per revolution may be calculated if the four signals are received. Of course the same principles could be used with one laser and Herald, but two are preferred for reliability and speed of angle acquisition.

As mentioned previously, received pulses result in numbers being stored in FIFO register 47. These numbers are then processed by microprocessor 48. For example, to acquire synchronisatiòn, the microprocessor 48 has to detect three xenon pulses with a period consistent to a certain tolerance such as 1% preferably and within a range of 37.5+15%−5% milliseconds. The tolerance is larger positive than negative because the beacon is more likely to run slow than fast.

To maintain synchronisation, the xenon pulses must fit in a time slot or "window" defined by a software "flywheel". Up to six consecutive xenon pulses may be missing. Up to 10 noise pulses between consecutive detected xenon pulses are ignored, but fewer noise pulses are allowed as the number of missed xenon pulses increases. This limits the degradation by noise for a system already degraded by loss of information.

Pulses falling in either of two windows, defined by the "flywheel", will be identified as Herald pulses. The two windows occur between every two xenon pulses.

The term "flywheel" is borrowed from the world of mechanics. The fundamental property of a flywheel is, that once it is made to rotate, it will tend to do so at a constant speed. This speed of rotation may be adjusted faster or slower by adding or subtracting energy. When connected into a dynamic system, where the driving power and/or the load (power take off) are fluctuating, it will tend to smooth out irregularities in the speed of rotation. The "software flywheel" of this invention is a cyclic process based on the system clock which is set to present a pattern of time slots (windows) occurring at the nominal rate of arrival of xenon pulses from the beacon. The pulses are very brief compared to the duration of the time slots so that even though the pulse and time slot rates may differ, two or three consecutive pulses may be detected in the slots and recognized as xenon pulses. Once recognized, their average spacing in time is measured and the "flywheel" speed adjusted in synchronism with the mean rate of the received pulses. Synchronization has thus been achieved. Once this condition is reached, slow fluctuations in the beacon speed can be followed and synchronism maintained. Additionally, small, rapid fluctuations in speed (jitter) will be smoothed out since the servo loop which maintains synchronism will not respond to the rapid changes.

The system, on seeing a recognizable chain of pulses, continues to expect pulses to arrive, in the same way as a mechanical flywheel is expected to keep rotating. There is one fundamental difference, however. The "software flywheel" only starts upon receiving a pulse and immediately jumps to the mean design speed for the beacon, a process impossible with a mechanical flywheel.

It should be noted that the "windows" or "time slots" are not, in fact, periods of real time, but are simply a bracketed series of numbers which would rate a pulse as valid if its number (assigned upon entry into FIFO 47) were within that bracket.

Any two pulses separated by 50.5±5 μs, 71.5±7 μs, 101±10 μs or 143±14 μs are identified as laser pulses. These four windows cover both lasers with up to one pulse missed. Identification of a pulse as a laser pulse inhibits its identification as a xenon or a Herald.

Once two laser pulses have been identified, the actual laser pulse spacing of the current burst is calculated. Further pulses are identified as laser pulses if they fit the spacing of the current burst and there is not more than 1 missed laser pulse between the current pulse and the preceding laser pulse. Also, if two or more laser pulses are missed, then two or more pulses with the spacing of the current burst and with not more than 1 missed laser pulse between them will be identified as further pulses of the current burst. This is intended to cover the case of a laser burst with side lobes.

If more than one noise pulse occurs between two detected laser pulses or within two pulse spaces of a detected pulse, then the whole burst is rejected.

This process continues until the second xenon from the start of the laser burst is received (which will be between 37.5 and 75 milliseconds). The laser burst is then assumed to be complete.

The centre time of the laser burst is calculated from the mean of the first identified laser pulse and the last identified laser pulse. This ensures that missed pulses occurring other than at the start or end of a burst will not affect the computed laser time.

If the conditions required to maintain sync, discussed above, are not met, then sync is lost. The system immediately attempts to reacquire sync. Provided that sync is reacquired in a reasonable time, about 1 second, angular information will be maintained, as described later.

Angular output data comprising the angles $\psi$, $\theta$ and $\phi$ on FIG. 1 may be presented on demand on the numerical display 54 on FIG. 4, controlled by the microprocessor 48.

A xenon sync lamp is illuminated to show that the receiver is detecting a satisfactory number of xenon pulses. The lamp is driven by a retriggerable hardware monostable multivibrator, not shown, with a period of approximately 40 ms. The monostable is triggered by a pulse output from the microprocessor 48 every time a xenon pulse is detected or inserted during synchronized running, i.e., every 37.5 ms.

A laser indicator lamp is illuminated to show that the receiver is detecting laser bursts. This lamp is turned off by a software timer after a period of approximately 1.6 secs. This timer is reset and the lamp lit by the microprocessor every time a laser burst is detected.

A valid angle lamp is driven through a hardware gate and monostable multivibrator so that it can only be illuminated when both the xenon sync lamp is illuminated and a valid angle output of the microprocessor is high. The multivibrator responds instantly to illuminate the lamp but will maintain it illuminated for 9 seconds after the valid signal from the gate is removed. This arrangement prevents the lamp from flashing when signal reception is poor. The valid angle output is set by an angle validation procedure described below.

The microprocessor uses a regular interrupt from the counter timer circuit to implement the following real-time functions. Various flags and outputs which are reset by timeouts may well be reset by other functions also.

A first counter 51 is used to determine if the beam has been lost. This counter counts for 1 second and is reset by every xenon pulse detected during synchronized running. If the counter reaches its maximum value, the microprocessor assumes that the beam is lost and resets all flags.

A second counter 52 is used to determine if the laser signals have been lost. This counter counts up to 42 xenon periods, (approx. 1.6 seconds) unless reset by detection of a valid laser burst. If the counter reaches its maximum, the laser valid flag is reset.

A third counter 53 is used to determine if the Herald signals have been lost. It counts up to 42 xenon periods (approx. 1.6 seconds). If the counter reaches its maximum the Herald valid flag is reset.

VALIDATION CRITERIA

Angle Validation

Angles are not validated per se. To be valid an angle must have been calculated from a validated Herald and a validated laser and the laser and Herald must currently be valid.

Laser and Herald Validation

Laser bursts and Herald pulses are each validated in the same way as follows:

Where Synchronization is Maintained

Herald pulses are defined as valid if they meet the following criteria:

Either (a) Three consistent Heralds with no erroneous Heralds between—missing Heralds are allowed.

or (b) Two consistent consecutive Heralds with neither erroneous nor missing Heralds between.

Consistent Heralds are those which occur with a separation corresponding to the true physical angles between them as determined by the reference unit geometry.

Laser bursts are validated in exactly the same manner as Herald pulses.

If Synchronization is Lost

If synchronization is lost and then regained, Herald and laser burst values calculated before losing sync, cannot be compared with those calculated after sync is regained, because the reference point will change. In order not to drastically increase validation time when sync is lost, the following procedure is used.

At the time of losing sync an angle is calculated based on the most recent values of laser burst and Herald. At the same time status codes for the Herald and laser burst values used, are stored in memory 49. The Herald status code has a value as follows:

| | |
|---|---|
| Valid Herald or two consistent values with missed Herald between | code = 1 |
| Only one Herald of that value (i.e. this is either the first Herald detected or it is not consistent with the preceding Herald) | code = 0 |

The laser burst status code is determined in the same way.

When sync is regained, validation of Herald and laser recommences. When both a laser and a Herald have been detected an angle is calculated. It is compared with the previous valid angle (if any). If the angles are the same, then the new angle and the values of Herald and laser are all considered valid and the flags are updated.

If the new angle does not equal the previous valid angle, it is compared with the angle calculated on losing sync. If these two angles agree, Herald status is updated as follows:

a. New Herald is valid: if the Herald status code equals 1.

b. New Herald is valid: if two consistent Heralds with no erroneous Heralds between, have been detected since regaining sync.

c. New Herald requires one further consistent Herald for validation: if only one consistent Herald has been detected since regaining sync, and status code=0

Laser validation is updated the same way. In this way, the validation status is carried over, through a loss of sync.

If the new angle does not equal either the previous valid angle or the angle stored on losing sync, then the process of validation is recommenced on regaining sync.

FIGS. 5A to 5D comprise a flow chart illustrating operations performed by the microprocessor 48 using numbers from the FIFO register 47 (FIG. 4). Except when the cyclic counter 45 resets, the relative magnitudes of the numbers are proportional to the spacings between pulses detected by the receiver.

Beginning at block 50 in the flow chart of FIGS. 5A to 5D, the first task of the microprocessor is to acquire synchronization with the rate of rotation of the reference unit, as indicated by the xenon pulses. Therefore, as shown at 52, the microprocessor examines pulses to locate a group of 3 which are spaced by 37.5 ms+15%,−5% and spaced equally within ±1%. [Strictly speaking, the microprocessor examines numbers representing pulses but, for simplicity, this description will refer to the processing of "pulses".]

Once synchronization is established, the microprocessor moves to step 54 and acquires another pulse. At 56, a determination is made of whether a laser burst is in progress. If the answer is no (which includes "don't know") the procedure moves to step 58 where the spacing between the current pulse and the previous pulse is determined to see if they fit the pattern of a laser burst. If so, the procedure loops back to block 54 where another pulse is acquired. If the answer at 58 is "no", step 60 looks ahead to the next pulse to check that the current pulse is not a laser pulse. If it is, the procedure loops back to step 54 as indicated by line 61.

If, at step 56, it is determined that a laser burst is in progress, the procedure goes to step 62 to examine if the current pulse fits the timing pattern of the current laser burst. If the answer is yes, the procedure loops back to step 54 to acquire another pulse. If the answer is no, the procedure moves to step 64 to determine if the laser burst is excessively noisy. If so, the laser burst is rejected at 66 and the procedure moves to step 60. If it is not too noisy, the laser burst is not rejected and the procedure moves to step 60.

If step 60 determines that the current pulse is not a laser pulse, the procedure branches to step 70 which determines if the current pulse fits a Herald window. If it does, a branch is made to 72 where the time of the Herald is compared with previous ones to see if it is validated. If validated, step 74 calculates the running angle $\theta$ based on the latest laser and Herald. Following step 74, a decision is made at 76 as to whether sync has been acquired since the previous calculation. If not, step 78 checks if the laser and Herald are both valid and, if not, the procedure goes to step 80 and, if either the laser or Herald has not been validated for 9 secs., the "valid" lamp is extinguished, step 82, and then at step 84, the procedure instructs a branch to "acquire pulse"(step 54).

If step 70 determines that the current pulse does not fit a Herald window, a branch is made to step 100 to see if the pulse is in a xenon window, or before or after a xenon window. If it is before (sooner), step 102 determines if the noise level and time from the last detected xenon are below a critical level, as shown. If so, a branch is made to step 54 to acquire a new pulse. If not, a branch, step 104, is made to step 50 to reacquire sync.

If at step 100 it is found that the pulse is after the xenon window, a xenon "fill" is made at step 106 and a count of one is added to the "xenon fill" counter. Step 107 reviews this counter and if greater than six the procedure goes to reacquire sync, otherwise the procedure goes to step 70 to try again.

If the pulse is in a xenon window, a branch is made to step 108 where, if necessary, an adustment can be made to the "flywheel" to compensate for a change of beacon speed. Step 110 then checks if this is the second xenon from the start of a laser burst and, if not, a branch is made to step 54 to acquire another pulse. If it is the second such xenon, a branch is made to step 112 which compares the time of the laser burst with previous ones to see if it's valid, after which the procedure moves to step 74, discussed above.

If a yes answer is determined at step 76, step 114 then compares the running angle with previous ones to determine if it is valid and updates the laser and Herald validation counters. Then step 116 checks if the angle is valid. If so, a branch is made to step 88, discussed above. If not, a branch is made to step 80, discussed in part above. If step 80 determines that the laser and Herald pulses are valid, a branch is made to step 118 to illuminate the "valid" lamp and then to step 84, discussed above.

The software flywheel referred to in step 108 is a scheme for maintaining synchronization in which the average time between two Xenon pulses is measured and updated each time a new valid Xe pulse is detected. A Xe pulse is considered valid if it is detected within a time interval referred to as the Xe window.

The window should be located exactly where the next Xe pulse is expected to occur. It should be narrow to discriminate against noise pulses, in fact it is +15%, −5% (20% of the mean time between Xe pulses) wide to allow for possible change in the rotation speed of the reference unit (due to temperature and/or battery state).

Each time a valid Xe pulse is detected, it is used to update the mean time between Xe pulses (108). This mean time will increase as the beacon rotation speed decreases and vice versa. If the detected Xe pulse arrives before or after the Xe window, it must not be used to compute the mean time between Xe pulses since it is probably a noise pulse.

The flywheel effect will optimize the positioning of the Xe window according to the computed mean time between validated Xe pulses. Adjustment is made to the flywheel to optimize the position of the window.

The embodiments of the invention in which an exclusive property or privilege is claimed are defined as follows:

1. An azimuth alignment system comprising a reference unit including a first portion adapted to be aligned in a known orientation and a rotatable portion having two sources of highly directional light pulses aligned approximately 180° apart and adapted to be rotated about a vertical axis, a source of omnidirectional light pulses, said two sources of highly directional light pulses comprising first and second lasers and said source of omnidirectional light pulses comprising a xenon flash tube, said first and second lasers being pulsed at different rates whereby they can be identified in accordance with their pulse rates, and trigger means to enable each source of omnidirectional light pulses each time it rotates by a predetermined angular increment and when it passes each of two predetermined reference directions, said trigger means comprising an optical encoder disc which rotates with said rotatable portion of the reference unit, said disc including markings to trigger said xenon flash tube, said system including a detector unit mounted on a device to be aligned, which detector unit includes an optical receiver for receiving light pulses, means for generating and storing numbers each having a magnitude proportional to time of arrival of a light pulse at said optical receiver, said means for generating and storing numbers comprising a cyclic counter driven by a source of clock pulses, said counter having parallel outputs feeding a FIFO register for storing said numbers, said detector unit comprising a photodetector which, upon detection of a light pulse, triggers a monostable multivibrator, said monotable multivibrator when triggered causing said cyclic counter to store its count in said FIFO register, microprocessor means for processing said numbers to determine the angle through which pulses emitted by each source of highly directional light pulses travel between each reference direction and the direction of said detector unit, such that said angle may be determined twice for each rotation of said rotatable portion of the reference unit, and means for displaying data representing said angle and system status, wherein said omnidirectional pulses are recognized depending on whether they occur within predetermined time windows.

2. An azimuth alignment system comprising a reference unit including a first portion adapted to be aligned in a known orientation and a rotatable portion having at least one source of highly directional light pulses adapted to be rotated about a vertical axis, a source of omnidirectional light pulses, and trigger means to enable said source of omnidirectional light pulses each time said source of highly directional light pulses rotates by a predetermined angular increment and when said source of highly directional light pulses passes a predetermined reference direction, said system including a detector unit mounted on a device to be aligned, said detector unit including an optical receiver for receiving light pulses, means for generating and storing numbers each having a magnitude proportional to time of arrival of a light pulse at said optical receiver, and means for processing said numbers to determine the angle through which pulses emitted by said source of highly directional light pulses travel between said reference direction and the direction of said detector unit, said means for generating and storing numbers comprising discrimination means for discriminating pulses received by said optical receiver which arrive at times corresponding to a predetermined cyclical pattern of pulses and pulses received by said optical receiver which do not arrive at times corresponding to said predetermined cyclical pattern of pulses.

3. An azimuth alignment system as in claim 2, wherein said means for generating and storing further comprises means for dumping stored numbers when said means for generating and storing is filled with data representing pulses which do not arrive at times corresponding to said predetermined cyclical pattern.

4. An azimuth alignment system as in claim 2, further comprising means, responsive to receipt of a pulse from said source of omnidirectional light pulses, for establishing a pattern of a bracketed series of numbers representing time slots occurring at a speed corresponding to a nominal rate of arrival of said pulses from said source of omnidirectional light pulses at said optical receiver, said means for establishing comprising (i) means for detecting and recognizing consecutive pulses from said source of omnidirectional light pulses within said time slots, (ii) means for determining an average spacing in time of at least two of said consecutive pulses, and (iii) means for adjusting said speed of occurrence of said time slots to correspond with said average spacing in time.

5. An azimuth alignment system as in claim 4, wherein said means for determining an average spacing comprises means for updating the determined average spacing in time between two consecutive pulses each time one of said consecutive pulses is detected and recognized.

* * * * *